United States Patent [19]

Gloviak et al.

[11] Patent Number: 4,917,300

[45] Date of Patent: Apr. 17, 1990

[54] PAINT SPRAY GUN

[75] Inventors: John A. Gloviak, Chicago; Tom G. Sprandel, Park Ridge, both of Ill.

[73] Assignee: Stewart Warner Alemite Corporation, Charlotte, N.C.

[21] Appl. No.: 727,065

[22] Filed: Apr. 25, 1985

[51] Int. Cl.[4] ..... B05B 5/02

[52] U.S. Cl. ..... 239/290; 239/296; 239/600

[58] Field of Search ..... 239/527, 528, 290, 300, 239/301, 414, 296, 299, 601, 415, 705, 600

[56] References Cited

U.S. PATENT DOCUMENTS 2,146,416 2/1939 Bramsen et al. ..... 239/300
2,504,116 4/1950 Downs ..... 239/300
2,739,843 3/1956 Baur ..... 239/528 X
3,746,253 7/1973 Walberg ..... 239/705
4,502,629 3/1985 McGhee et al. ..... 239/705 X

FOREIGN PATENT DOCUMENTS 802442 2/1951 Fed. Rep. of Germany ..... 239/296

*Primary Examiner*—Andres Kashnikow
*Attorney, Agent, or Firm*—Lorusso & Loud

[57] ABSTRACT

A paint spray gun in which its nozzle, nozzle-gun adapter and paint inlet fitting are all formed by a single plastic nozzle unit, and its air cap is also a one-piece plastic molding. Minor molding inaccuracies in these parts are corrected by thin section nozzle unit walls that engage portions of the air cap.

12 Claims, 3 Drawing Sheets

PAINT SPRAY GUN

BACKGROUND OF THE INVENTION

The present spray gun is of the hand-held air syphon operated type gun in which air is supplied to a control valve in a valve body hand-grip through an air fitting at the base of the grip. The trigger lever operated valve controls the flow of air through the valve body to a nozzle on the muzzle end of the gun, and this air is directed around a nozzle tip extending within an orifice in an air cap surrounding the nozzle tip whereby paint is aspirated through the nozzle from an adjacent container.

The nozzle assembly usually includes three machined parts, i.e. a nozzle, an adapter for attaching the nozzle to the valve body and a fluid inlet fitting connected to the fluid adapter to receive the paint container. These thre parts and a fourth, the air cap, are all constructed of metal and require a plurality of machining operataionns, rendering the nozzle assembly and air cap a major portion of the cost of the total spray gun.

Over and above the high cost of forming and machining the three nozzle assembly parts and the air cap, a major cause of poor paint atomization in spray guns is air leakage and the joints between the paint inlet fitting and the fluid adapter, between the fluid adapter and the nozzle, and between the adapter and the valve body, significantly increase the likelihood of this air leakage.

While it would be desirable to form the nozzle assembly parts and the air cap from molded plastic materials, it has not thus far been practical because the dimensional instability of plastics in the plastic moldin operation does not satisfy the accuracy requirements for the nozzle assembly and air cap. For example, it is extremely important that the nozzle tip be perfectly concentric with the air cap orifice, and plastic moldings hae not as yet achieved the required accuracy because of shrinkage and distortion. Furthermore, it is also necessry that the extent of axial projection of the nozzle tip from the air cap orifice be accurately controlled, and it was not heretofore thought possible that such axial control could be achieved with plastic parts.

It is a primary object of the present invention to ameliorate the problems noted above in conventional air-operated paint spray guns and to provide simplified nozzle assembly and air cap parts.

SUMMARY OF THE PRESENT INVENTION

In accordance with the present invention a paint spray gun is provided in which four previously separately formed and machined parts, i.e. the fluid adapter, fluid nozzle, fluid supply tube, and air cap are replaced by two plastic moldings. The dimensional inaccuracies of the plastic moldings are corrected by thin flexible wall sections and interengaging surfaces on the part that straighten distored parts into dimensionally precise locations.

Toward these ends a one-piece nozzle unit includes a pair of spaced annular concentric walls surrounding a tapered nozzle tip adapted to receive a needle valve. An air inlet boss that replaces the adapter is provided and communicates with the annular space between the walls as well as the annular space between the inner one of the walls and the nozzle tip portion to provide the necessary air flow around the tip and to outlet ports in the covering air cap. The outer annular space provides "wing air" to ports found on the air cap.

The inner one of the annular walls has a frustoconical end surface that engages a complementary frustoconical surface projecting rearwardly and innegrally from the air cap. This interengagement accurately axially locates the nozzle tip in the air cap central orifice, which is critical to paint delivery because tip protrusion must be just right—too muh or too little will reduce the rate of fluid delivery. Furthermore, these frusto-conical surfaces provide radial location for the parts and the relatively thin wall sections of both the air cap and the nozzle unit permit these surfaces to conform slightly oval parts without disturbing nozzle tip protrusion or concentricity.

Nozzle tip concentricity with the air cap central orifice is achieved by a plurality of radial vanes on a tapered portion of the nozzle tip that fit within an annular extension on the rear of the air cap surrounding the air cap orifice. This interengagement of the nozzle vanes with the air cap extension centers the tip in the orifice and thus corrects minor distortion of the nozzle tip from the air cap orifice axis.

The replacemennt of three machined parts with one plastic molding in the nozzle unit significantly reduces air leakage in the nozzle assembly and thereby improves paint atomization and also signficantly lowers manufacturing cost.

The rotational location of the air cap with respect to the nozzle unit in one or four orthogonal positions is determined by four integral flexible rearwardly-extending projections on the air cap which selectively snap over an axial rib on the interior of the nozzle unit inner annular wall to rotationally lock the air cap on the nozzle unit without requiring the addition of any separate parts.

In short, the present nozzle unit and air cap significantly increase paint atomization performance, and dramatically reduce manufacturing costs without any sacrifice in spray gun features of reliability.

DETAILED DESCRIPTION OF THE PREFERRED EMBODIMENT

Figure 1:
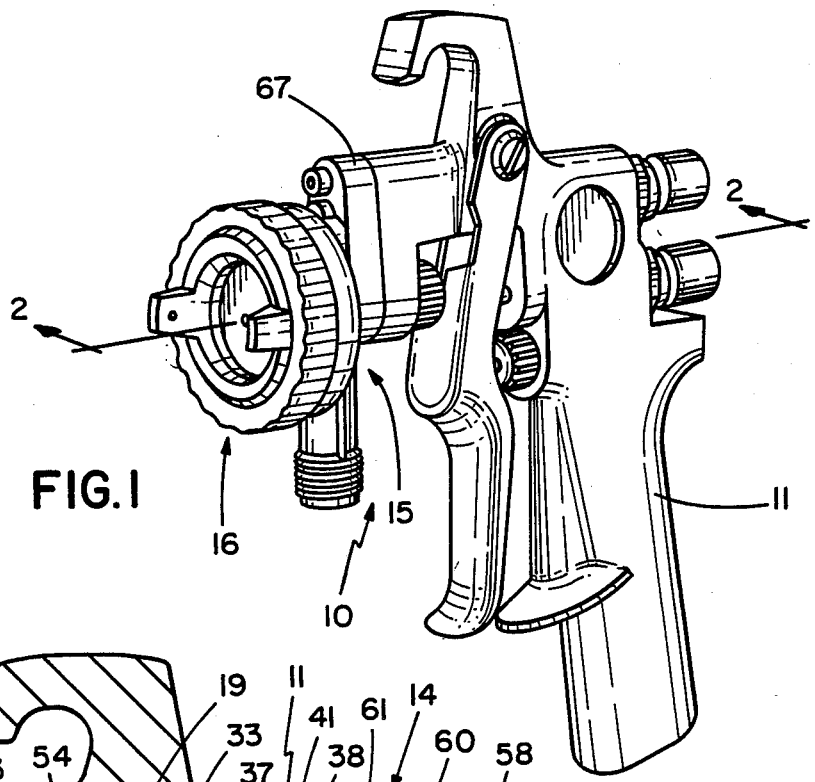
FIG. 1 is a perspective view of a paint spray gun according to the present invention.
Figure 2:
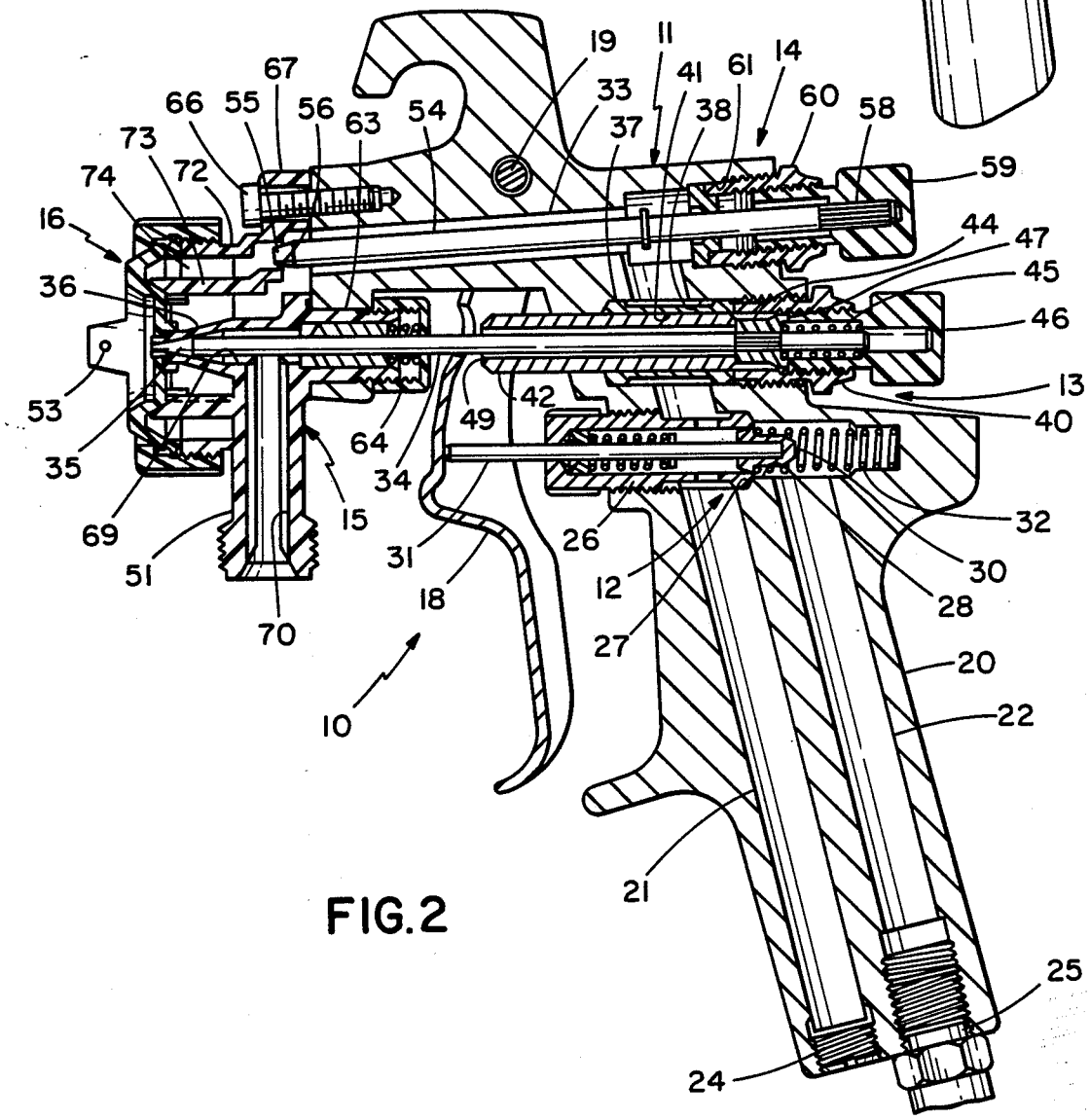
FIG. 2 is an enlarged longitudinal section of the present paint spray gun taken generally along line 2—2 of FIG. 1.

Referring to the drawings and particularly FIGS. 1 and 2, a spray gun 10 according to the present invention nis illustrated consisting generally of a body 11, a mainn air control valve assembly 12, a fluid control valve assembly 13, air air spray or wing air control valve 14, a nozzle unit 15 and an air cap assembly 16, with air valve assembly 12 and fluid valve assembly 13 being operated by a finger grip lever 18 pivoted on the body at 19.

The body 11 is generally "L" shaped and has a hand grip portion 20 with spaced parallel bores 21 and 22 therein. Bore 21 is plugged at its lower end 24 and an air inlet fitting 25 is threaded into the lower end of bore 22.

The air valve assembly 12 controls air flow between passages 22 and 21 to initiate and modulate the flow of compressed air to the nozzle unit 15 and air cap assembly 16, and includes a body member 26 threaded into handle grip 20 intersecting bore 22 and engaging a stepped shoulder 27 in a bore 28 interconnecting passages 21 and 22. Body member 26 has a valve seat 29 against which a valve member 30 is biased by compression spring 32 toward its closed position. Valve member 30 is selectively movable to its open position by rod 31 upon counterclockwise pivotal movement of the lever 18, as seen in FIG. 2. Upon depression of handle 18 valve member 30 opens permitting compressed air to flow from passage 22 to passage 21, through bore 33 to the nozzle unit 15 and air cap assembly 16.

The fluid or paint control valve 13 includes a needle valve 34 having a frusto-conicla tip 35 that cooperates with a frusto-conical nozzle tip portion 36 in the nozzle unit 15 to form a variable orifice for the control of paint flow through the nozzlel unit 15. Valve assembly 13 also includes a sleeve 37 in a handle bore 38 held in position by a threaded bushing 40 together defining a bore 41 that slidably receives an actuator sleeve 42 and nbushing 44, the latter being press-fitted on needle valve 34. Valve 34 is biased to its closed position illustrated in FIG. 2 by a coil compression spring 45 seated in adjustment knob 46 and reacting against the bushing 44 urginng it toward the left as seen in FIG. 2. Knob 46 is threadedly engaged in bushing 40 and limits the opening movement of valve 34 when bushing rim 47 engages the knob. Knob 46 is unthreaded from its position shown in FIG. 2 to permit opening movement of valve 34. Lever 18 engages end 49 of sleeve 42 to cause opening movement of the valve 34 afer valve 12 opens by shifting bushing 44 to the right from its position shown in FIG. 2, opening valve 34 permitting paint to flow through nozzle unit inlet fitting 51 across open needle valve portion 35.

The air spray or wing air valve assembly 14 controls air flow through passage 33 to wing spray ports 53 that direct an air spray against paint flow from nozzle tip 36 to control the flow pattern. Valve assembly 13 includes a rod valve 54 having a frusto-conical tip 55 adjustably positionable in a circular valve seat 56 formed in the nozzle unit 15. Rod valve 54 has a straight knurl 58 at its right end pressed in adjustmentn knob 59 in turn threaded into a bushing 60 threaded into a body bore 61. Rotation of knob 599 varies the flow area at valve seat 56 and hence the flow rate through wing ports 53.

The nozzle unit 15 is a one-piece plastic molding, preferably constructed of nylon, and is seen to include a valve guide portion 63 extending through a bore in the forward end of valve body 11, having a threaded end that receives a threaded cap 64 that holds the nozzle unit 15 against the forward face of the valve body 11 with the assistance of a threaded fastener 66. The guide portionn 63 extends rearwardly from a vertically elongated base portion 67 shown more clearly in FIG. 1, and the nozzle portion 36 extends coaxially with respect to teh guide portion 63 forwardly from the base portion 67. Inlet fitting 51 extends transversely from the nozzle tip portion 36 that has an axial passage 69 therethrough communicating with passage 70 in inlet fittign 51 which is adapted to be connected to a conventional paint supply container (not shown).

The nozzle unit 15 has a pair of forwardly projecting annular walls 72 and 73 from ase 67 that define an annular passage 74 for the supply of air from valve assembly 14 through valve seat 56 to the wing air spray ports 53 in n air cap 76.

Figure 3:
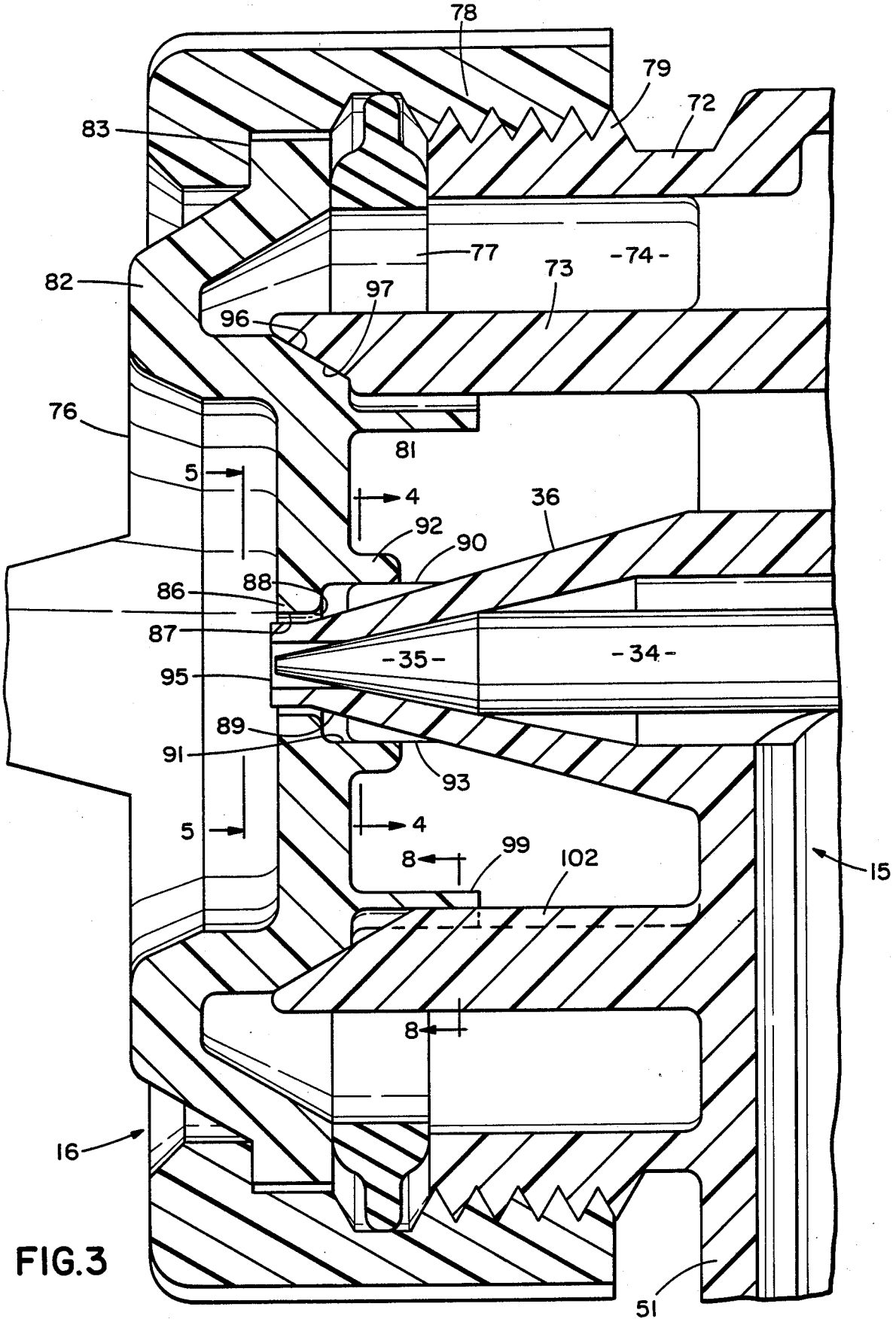
FIG. 3 is an enlarged fragmentary section of the nozzle unit and air cap assembled together.
Figure 4:
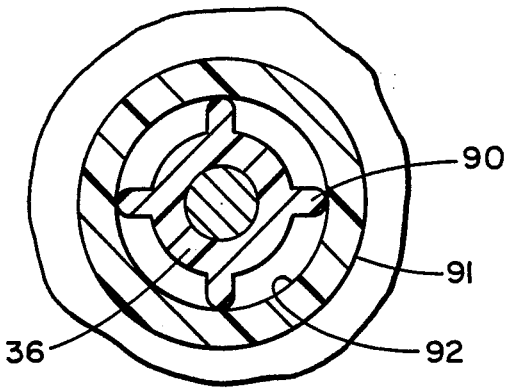
FIG. 4 is a fragementary cross-section taken generally along line 4—4 of FIG. 3 illustrating the nozzle tip portion alignment vanes.
Figure 5:
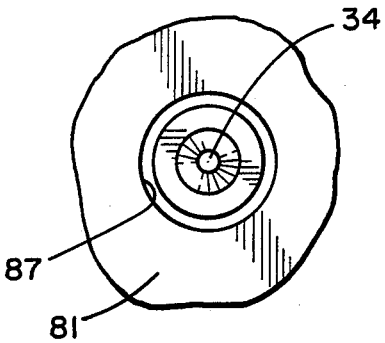
FIG. 5 is a fragmentary view taken generally along line 5—5 of FIG. 3 showing the concentric relationship of the nozzle tip portion and the air orifice.

As seen more clearly in FIG. 3, the air cap assembly 16 includes the air cap 76 clamped in position against an annular seal 77 by a cup-shaped plastic nut 78 that threadedly engages external threads 79 on the nozzle outer annular wall 72.

Figure 6:
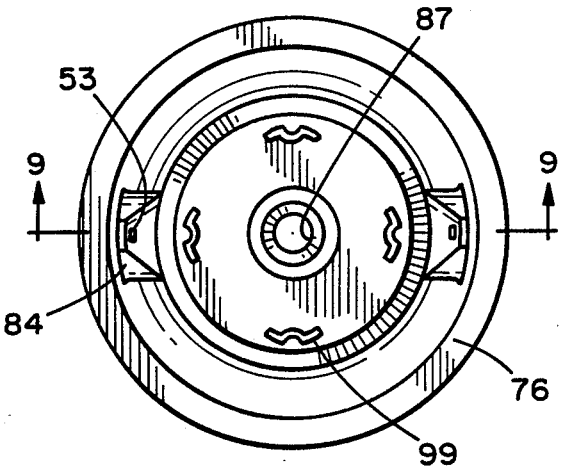
FIG. 6 is a rear view of the air cap sub-assembly.
Figure 7:
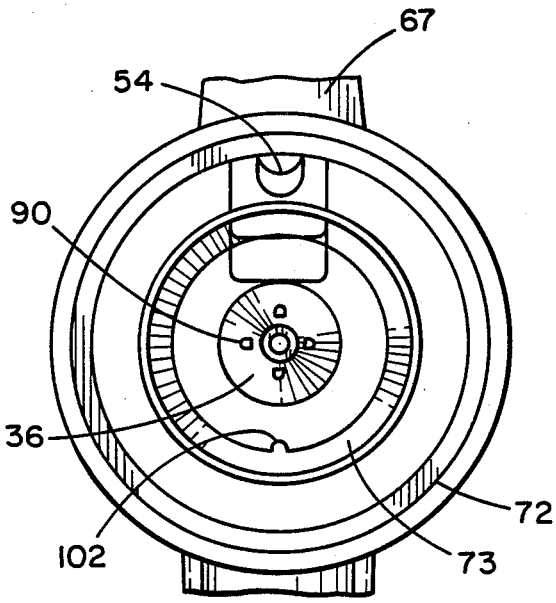
FIG. 7 is a partly fragmentary front view of the nozzle unit.
Figure 8:
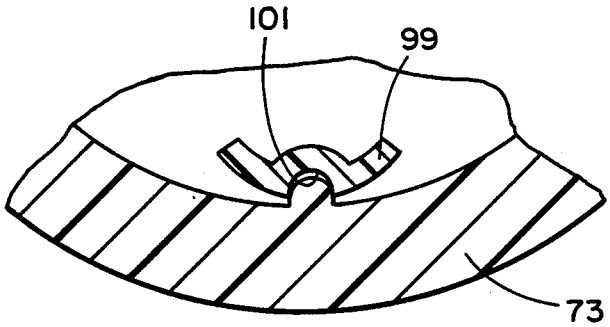
FIG. 8 is a fragmentary section taken generally along line 8—8 of FIG. 3 illustrating the air cap detent mechanism.
Figure 9:
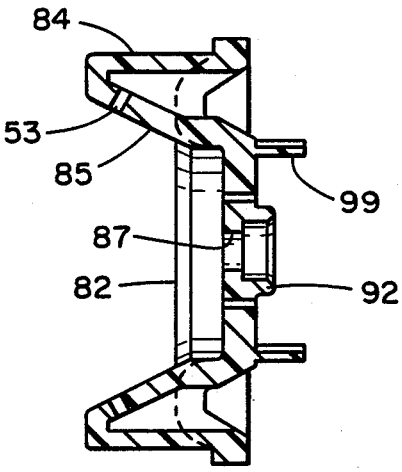
FIG. 9 is a cross-section of the air cap taken generally along line 9—9 of FIG. 6.

The air cap 76 is a one-piece plastic molding, preferably constructed of a durable plastic such as nylon, and is seen in FIGS. 3, 6 and 9 to include a central cup-shaped portion 81, an annular forwardly projecting "U" shaped rim 82 and an annular outer flange 83 against which nut 78 clamps. Diametrally spaced ears or wings 84 (see FIG. 9) extend forwardly from rim 82, and have outwardly diverging flat inner surfaces 85 in which the spray ports 53 are formed.

The cup-shaped portion 81 has a reduced thickness central wall portion n86 in which orifice 87 is centrally formed. Orifice 87 has a semi-torroidal rear surface 88 to reduce turbulence. Orifice 87 and the straight portio nof the distal end of nozzle tip 36 determines the effective flow area for syphon air flowing past nozzle tip end 95.

The frusto-conical portion 89 of nozzle tip 36 has four integral equally spaced radial vanes 90 that engage a cylindrical inner wall 91 in an annular projection 92 extending rearwardly from air cap portion 81, to accurately align the nozzle tip 36 on the axis of the orifice 87 in the air cap 76. These vanes have ouer edges 93 that extend parallel to the axis of the nozzle tip 36 and have line contact with the air cap wall 91.

In addition to maintaininng the radial alignment of the nozzle tip 36 in the air cap orifice 87, it is also extremely important to control the amount of protrusion of nozzle tip end 95 forwardly from the orifice 87. Toward this end the air cap cup portion 81 has an outer frusto-conical surface 96 that engages an inner frusto-conical forward surface 97 on thef orward end of nozzle unit wall 73. These frusto-conical surfaces both radially and axially locate the air cap 76 with respect to the nozzle unit 15. Moreover, the wall sections throughout the nozzle unit 15 and the air cap 76 are relatively thin so that they are flexible under the interengaging forces produced at surfaces 96 and 97 as well as at vanes 90 and wall 91. In this manner mold distortion causing out-of-round parts or misalignment of the nozzle projection 36 are corrected as the air cap 76 is fitted over the nozzle unit 15 and the parts come into conformity.

The rotational position of the air cap 76 with respect to the nozzle unit 15 is precisely determined by four rearwardly extending radially flexible projections 99 on the air cap 76 that have outer recesses 101 that selectively fit over an integral axial rib 102 on the inside of the nozzle unit inner annular wall 73. This permits the flexible projections 99 to sna over rib 102 and lock the air cap 76 in any of four orthogonal positions with respect to the nozzle unit 15. This adjustment lets the operator control wing air direction and flow pattern orientation.

We claim:

1. A paint spray gun, comprising; a valve body having an air passage therethrough adapted to be connected to a source of compressed air, a control valve in the passage for controlling the flow of air, a unitary plastic nozzle unit including an air inlet passage, a paint inlet passage and an elongated nozzle tip portion connected to receive paint from the paint inlet passage, said nozzle tip portion having a sufficiently thin axially extending generally annular wall so that the nozzle tip portion is radially flexible, and a forward end, an air cap covering the nozzle unit and adapted to receive air from the nozzle unit air inlet, said air cap having a central orifice into which the nozzle tip portion projects, and interengaging means on the air cap and the forward end of the flexible nozzle tip portion directly adjacent to the air cap central orifice for aligning the plastic nozzle tip portion in the air cap orifice even though the end of the nozzle tip portion is not perfectly concentric with the orifice.

2. A paint spray gun as defined in claim 1, wherein the interengaging means includes an annular projection on the air cap concentric with the orifice having an inner annular surface, and a plurality of integral radial vanes projecting ourwardly from the distal end of the nozzle tip portion.

3. A paint spray gun as defined in claim 2, wherein the air cap is a unitary plastic molding.

4. A paint spray gun as defined in claim 1, including second interengaging means on the air cap and nozzle unit for axially locating the nozzle tip portion in the air cap orifice.

5. A paint spray gun as defined in claim 4, wherein the secondn interengaging means includes a pair of interengaging frusto-conical surfaces on the air cap and the nozzle unit.

6. A paint spray gun as defined in claim 1 wherein the interengaging means includes a pair of frusto-conical surfaces on the air cap and the nozzle unit, said air cap being a unitary plastic molding, said air cap and nozzle unit having sufficiently thin sections adjacent the frusto-conical surfaces so that in the event one or the other is not molded accurately the engaging frusto-conical surfaces will straighten the inaccurately molded one.

7. A paint spray gun, comprising; a valve body having an air passage therethrough adapted to be connected to a source of compressed air, a control valve in the passage for controlling the flow of air, a unitary plastic nozzle unit having an axis and including an air inlet passage, a paint inlet passage and an elongated nozzle tip portion connected to receive paintn from the paint inlet passage, said nozzle unit air inlet passage being annular in configuration and defined by a pair of forwardly extending integral substantially concentric radially spaced annular walls, the inner oen of said annular walls having a frustoconical alignment surface, said nozzle unit paint inlet passage being defined by an inegral fitting extending transversely with respect to the axis of the nozzle unit, a needle valve axially movable in the nozzle tip portion to control paintn flow, a one-piece plastic air cap mounted over the nozzle unit having a central orifice and an annular air passage communicating with the nozzle unit air inlet passage, the outer one of said nozzle unit annular walls holding the air cap in position, and a plurality of air outlet ports in the air cap, said air cap having a rearwardly extending annular wall with a frustoconical surface aligned with and engaging the frusto-conical surface on the nozzle unit inner wall to axially locate the nozzle tip portion in the air cap, said nozzle tip portion having a sufficiently thin axially extending generally annular wall so that the nozzle tip portion is radially flexible, and a forward end, and interengaging means on the air cap and the forward end of the flexible nozzle tip portion directly adjacent the air cap central orifice for aligning the plastic nozzle tip portion in the air cap orifice even though the end of the nozzle tip portion is not perfectly concentric with the orifice.

8. A paint spray gun as defined in claim 7, wherein said nozzle unit includes a rearwardly extending integral fitting adapted to slildably receive the needle valve.

9. A paint spray gun, comprising; a valve body having an air passage therethrough adapted to be connected to a source of compressed air, a control valve in the passage for controlling the flow of air, a unitary plastic nozzle unit having an axis and including an air inlet passage, a paint inlet passage and an elongated nozzle tip portion connected to receive paint from the paint inlet passage, said nozzle unit air inlet passage being annular in configuration and defined by a pair of integral forwardly extending substantially concentric radially spaced annular walls, the innenr one of said annular walls having a frustoconical alignment surface, said nozzle unit paint inlet passage being defined by an integral fitting extending transversely with respect to the axis of the nozzle unit, a needle valve axially movable in the nozzle tip portion to control paint flow, a one-piece plastic air cap mounted over the nozzle unit having a central orifice and an annular air passage communicatinng with the nonzzle unit air inlet passage, said nozzle unit outer wall holding the air cap in position, and a plurality of air outlet ports in the air cap, and air cap having a rearwardly extending annular wall with a frusto-conical surface aligned with and engaging the frusto-conical surface on he nozzle unit inner wall to axially locate the nozzle tip portion in the air cap, said nozzle tip portion having a sufficiently thin axially extending generally annular wall so that the nozzle tip portion is radially flexible, said nozzle tip portion including a frusto-conical portion with a plurality of radially extending vanes thereon, said vanes each having an axially extending outer surface parallel to the axis of the nozzle tip portion, said air cap having a rearwardly extending annular projection directly adjacent the air cap central orifice coaxial with the orifice and adapted to receive and engage the vanes' outer surfaces to align the nozzle tip portion in the air cap orifice.

10. A paint spray gun, comprising; a valve body having an air passage therethrough adapted to be connected to a source of compressed air, a control valve in the passage for controlling the flow of air, a uniary plastic nozzle unit including an air inlet passage, a paint inlet passage and an elongnated nozzle tip portion connected to receive paint from the paint inlet passage, said nozzle unti air inlet passage being annular in configuration and defined by a pair of integral substantially concentric radially spaced annular walls, the inner one of said annualr walls having a frusto-conical alignment surface, said nozzle unit paint inlet passage being defined by an integral fitting extending transversely from the nozzle unit, a needle valve axially movable in the nozzle tip portion to control paint flow, a one-piece plastic air cap mounted over the nozzle inlet having a central orifice and an annular air passage communicating with the nozzle unit air passage, a plurality of air outlet ports in the air cap, said air cap having a frusto-conical surface aligned with and engaging the frusto-conical surface on the nozzle unit inner wall to axially locate the nozzle tip portion in the air cap, said nozzle tip portion inncluding a frusto-conical portion with a plurality of radially extending vanes thereon, said vanes each having an axially extending outer surface parallel to the axis of the nozzle tip, said air cap having a rearwardly extending annular projection coaxial with the orifics and adapted to receive and enngage the vanes' outer surfaces to align the nozzle tip portion in the air cap orifice, an integral detent projection extending radially inwardly from the nozzle unit adjacent the air cap, and a plurality of angularly spaced integral raldially flexible projections extending axially rearwardlyf rom the air cap each having a recess therein positioned to snap over the nozzle unit detent projection to rotationally position the air cap with respect to the nozzle unit.

11. A paint spray gun, compmrising; a valve body having an air passage therethrough adapted to be connected to a source of compressed air, a control valve in the passage for controlling the flow of air, a unitary plastic nozzle unit including an air inlet passage, a paint inlet passage and an elongated nozzle tip portion connected to receive paint from the paint inlet passage, said nozzle tip portion including an axially extending generally annular wall sufficiently thin so that the tip portion is radially flexible, and having a forward end, an axially forwardly extending integral annular wall on the nozzle unit having a frusto-conical alignment surface, said annular wall being sufficiently thin so it is somewhat flexible, said nnozzle unit paint inlet passage being defined by a fitting extending generally ransversely from the nozzle unit, a needle valve axially movable in the nozzle tip portion to control paint flow, a one-piece plastic air cap mounted over the nozzle unit having a central orifice and an annular air passage communicating with the nozzle unit air inlet passage, and a plurality if air outlet ports in the air cap, said air cap having a rearwardly extending frusto-conical surface aligned with and engaging the frusto-conical surface on the nozzle unit wall to axially locate the nozzle tip portion in the air cap and to compensate for somewhat irregular nozzle unit walls, and interengaging means on the air cap and the forward end of the flexible nozzle tip portion directly adjacent the air cap central orifice for aligning the plastic nozzle tip portion in the air cap orifice even though the end of the nozzle tip portion is not perfectly concentric with the orifice.

12. A paint spray gun as defined in claim 11, wherein the air cap has a rearwardly extending annular wall defining the frusto-conical surface that is flexible to compensate for molding errors.

* * * * *